US010256547B2

(12) United States Patent
Urbasic et al.

(10) Patent No.: US 10,256,547 B2
(45) Date of Patent: Apr. 9, 2019

(54) DUAL POLARIZED ANTENNA

(71) Applicant: PC-TEL, Inc., Bloomingdale, IL (US)

(72) Inventors: David Edward Urbasic, Saint Charles, IL (US); Calin E. Pod, Crystal Lake, IL (US)

(73) Assignee: PC-TEL, Inc., Bloomingdale, IL (US)

( * ) Notice: Subject to any disclaimer, the term of this patent is extended or adjusted under 35 U.S.C. 154(b) by 19 days.

(21) Appl. No.: 14/942,204

(22) Filed: Nov. 16, 2015

(65) Prior Publication Data

US 2016/0141759 A1 May 19, 2016

Related U.S. Application Data

(60) Provisional application No. 62/080,729, filed on Nov. 17, 2014.

(51) Int. Cl.

| | |
|---|---|
| ***H01Q 13/02*** | (2006.01) |
| ***H01P 1/161*** | (2006.01) |
| ***H01Q 1/52*** | (2006.01) |
| ***H01Q 21/24*** | (2006.01) |
| ***H01Q 1/42*** | (2006.01) |
| ***H01Q 1/50*** | (2006.01) |
| ***H01Q 13/04*** | (2006.01) |

(52) U.S. Cl.

CPC ..... *H01Q 13/02* (2013.01); *H01P 1/161* (2013.01); *H01Q 1/42* (2013.01); *H01Q 1/50* (2013.01); *H01Q 1/526* (2013.01); *H01Q 13/0258* (2013.01); *H01Q 13/04* (2013.01); *H01Q 21/24* (2013.01)

(58) Field of Classification Search

CPC ..... H01Q 13/02; H01Q 13/04; H01Q 13/06; H01Q 13/065; H01Q 13/0241; H01Q 5/55; H01Q 21/24

USPC ..... 343/711–713, 717, 772–773, 784, 786

See application file for complete search history.

(56) References Cited

U.S. PATENT DOCUMENTS 3,576,581 A * 4/1971 Tricoles ..... H01Q 1/42 343/756

4,775,867 A * 10/1988 Sokol ..... H01Q 1/005 343/713

(Continued)

OTHER PUBLICATIONS

Extended European search report from corresponding EP patent application 15194919.5, dated Mar. 2, 2016.

*Primary Examiner* — Hoang V Nguyen
*Assistant Examiner* — Awat M Salih
(74) *Attorney, Agent, or Firm* — Husch Blackwell LLP

(57) ABSTRACT

A dual polarized antenna assembly that can be used in connection with rail-based high speed data transmission is provided. One or more high gain directional antennas can be included within a single package such that each package can include a waveguide feed, first and second probe feed assemblies terminating at the waveguide feed, and a horn flair coupled to a first end of the waveguide feed. The first probe feed assembly can be terminated orthogonally with respect to the second probe feed assembly, each probe feed assembly can be fed separately and radiate a linearly polarized signal into the waveguide such that each linearly polarized signal is parallel to the respective probe feed assembly, and each linearly polarized signal can propagate independently through the waveguide to the horn flair, which can couple each linearly polarized signal to free space.

3 Claims, 3 Drawing Sheets

(56) References Cited

U.S. PATENT DOCUMENTS

| | | | | |
|---|---|---|---|---|
| 6,624,792 | B1 * | 9/2003 | Chu | H01P 1/16 333/136 |
| 8,089,415 | B1 * | 1/2012 | West | H01Q 13/02 333/21 R |
| 2003/0058133 | A1 * | 3/2003 | Arnold | G01S 13/04 340/933 |
| 2008/0204348 | A1 * | 8/2008 | Nagano | H01Q 13/02 343/850 |
| 2011/0043422 | A1 * | 2/2011 | Lin | H01P 1/173 343/756 |
| 2014/0266942 | A1 * | 9/2014 | Voss | H01Q 13/02 343/756 |
| 2015/0357695 | A1 * | 12/2015 | Hagensen | H01P 1/173 333/21 A |

* cited by examiner

SECTION A-A

SECTION B-B

SECTION C-C

DUAL POLARIZED ANTENNA

CROSS-REFERENCE TO RELATED APPLICATIONS

This application claims priority to U.S. Provisional Patent Application No. 62/080,729 filed Nov. 17, 2014 and titled "Dual Polarized Antenna". U.S. Application No. 62/080,729 is hereby incorporated by reference.

FIELD

The present invention relates generally to antennas. More particularly, the present invention relates to a dual polarized antenna.

BACKGROUND

Known rail-based high speed data transmission includes a mobile system mounted on a rail car and a fixed system positioned trackside or wayside. Each of the mobile system and the fixed system includes a transceiver and an antenna for communication with the other system. Accordingly, as the rail car passes through the section of the track covered by the trackside antenna, data is transmitted between the mobile system and the trackside system. For example, the antenna at each transceiver sends and receives data via linearly polarized radiated fields at a given fixed polarization.

To improve the potential data throughput of known systems, multiple signals are transmitted simultaneously such that the transmitted signals fully share the entire specified frequency band. However, because two or more signals are sharing the same frequency band and wireless link, additional efforts must be taken to ensure that these signals do not interfere with each other.

To that end, in known systems, transmitted signals are linearly polarized. Accordingly, one known system and method to prevent interference includes polarization discrimination. For example, a first linearly polarized signal is typically orthogonal to a second linearly polarized signal. However, such signals require a transceiver that includes transceiving capabilities in both polarizations and an antenna designed and positioned to operate at each desired polarization. Indeed, to realize a two-port dual polarized system, known mobile systems and known trackside or wayside systems each include two individual antennas and mounts, thereby adding to the overall cost of the system.

The antennas typically used in known systems include a driven monopole with directors or a driven dipole end fire array antenna. Undesirably, each of these antennas achieves modest gain in a narrow band while providing varying performance over the band. Furthermore, whichever type of antenna is used, the vertically polarized antenna of the mobile system and the vertically polarized antenna of the trackside or wayside system must be rotated by some amount and mounted on a special platform to achieve the two different polarizations and realize orthogonality between element polarization. This can be physically bulky, mechanically complicated, and introduce additional potential points of failure.

Due to the architecture described above, known systems include the following disadvantages. First, known systems do not have symmetrical vertical and horizontal patterns when measured in free space. Accordingly, when two antennas are rotated and positioned to achieve certain polarizations with respect to their mounting surface, their patterns will not be identical. Second, known systems require a ground plane and perform significantly differently on and off the ground plane or over a non-conductive surface. Third, known systems require a robustly DC grounded driven element to realize high voltage protection. Finally, when multiple antennas are employed, multiple sealing points between the antennas and the rail care are required. This increases installation time, maintenance costs, and the number of potential points of failure.

In some situations, it is desirable to add a third linearly polarized radiating element to the mobile system and to the trackside or wayside system. However, in known systems, a third unique antenna is required to provide a third linearly polarized radiating element, further increasing the height or footprint of the system, necessitating an additional antenna seal, and introducing an antenna pattern performance that does not match the first and second antennas.

In view of the above, there is a need for improved systems.

DETAILED DESCRIPTION

Figure 1:
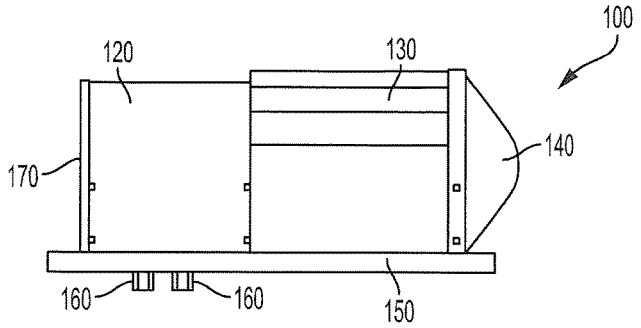
FIG. 1 is a side view of the exterior of an antenna assembly in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Wireless modems and routers can utilize a multiple input multiple output (MIMO) system and have unique electrical requirements. Furthermore, rail car antennas can have unique mechanical requirements. Indeed, the desire for a moving train to reliably connect with trackside antennas can introduce even more unique electrical and mechanical requirements.

Embodiments disclosed herein meet such requirements by providing a dual polarized antenna assembly that can be used in connection with rail-based high speed data transmission in the telecommunication, cellular, wireless infrastructure, public transport, travel, and related industries. For example, some embodiments disclosed herein can include one or more high gain directional antennas that can be included within a single package, thereby facilitating the ability to maintain a high speed data link with a train in motion for the benefit of both the train operator and passengers on board.

In accordance with disclosed embodiments, a single antenna assembly can include at least two ports and two polarizations, thereby allowing for increased transceiver throughput. Several advantages are realized and provided by embodiments disclosed herein.

First, embodiments disclosed herein can remove the need for individual and uniquely polarized directional antennas in separate packages, thereby removing the need for additional positioning hardware required to arrange vertically polarized antennas in such a way so as to have a proper polarization. Indeed, in disclosed embodiments, a majority of all parts related to antenna operation can be shared between two polarizations, and the single package disclosed herein can provide economy of cost, volume, and minimized points of failure. Furthermore, because special mounting is not required to achieve a desired polarization, polarization can be predetermined during a design phase, thereby eliminating mounting structures and reducing to one the number of sealing points between the antenna package and a mounting surface.

Second, embodiments disclosed herein can create a high degree of performance symmetry between each port and polarization of the antenna assembly. For example, embodiments disclosed herein can provide symmetry of elevation and horizontal radiation patterns, and with such pattern symmetry, any polarization rotation can be applied, resulting in the same elevation and horizontal pattern.

Third, embodiments disclosed herein can remove the need for a ground plane while also maintaining performance when mounted on a ground plane. For example, embodiments disclosed herein can incorporate a waveguide fed horn to achieve a broadband high gain and a highly directive solution that does not require a ground plane. However, embodiments disclosed herein can have little concern for ground plane effects and can also provide a uniform and minor beam tilt when dual slant +/−45° polarization is mounted on a ground plane.

Fourth, embodiments disclosed herein can provide high voltage discharge protection without compromising electrical performance. For example, embodiments disclosed herein do not require driven elements to be DC grounded to be able to pass a high voltage discharge test. Instead, the structural elements of embodiments disclosed herein can be DC grounded, and the driven elements can be well protected. However, when the driven elements are DC grounded, electrical performance is not compromised.

Finally, when desired, embodiments disclosed herein can provide an option to add a third polarization without compromising performance or increasing the footprint, volume, or size of the antenna assembly. Indeed, any number of additional linear polarizations can be added in the design phase, and as with a package with two polarizations, a package with three polarizations can share most of the same structure related to antenna operation, and performance symmetry between each polarization can be achieved.

Figure 2:
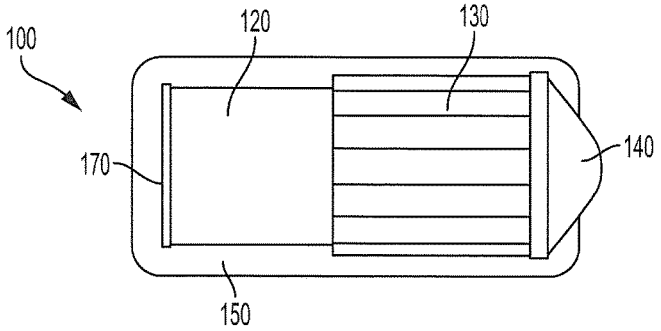
FIG. 2 is a top view of the exterior of an antenna assembly in accordance with disclosed embodiments.
Figure 3:
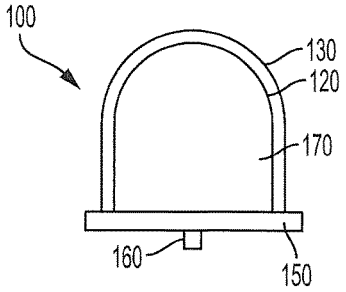
FIG. 3 is an end view of the exterior an antenna assembly in accordance with disclosed embodiments.

FIGS. 1, 2 and 3 are side, top, and end views, respectively, of the exterior an antenna assembly 100 in accordance with disclosed embodiments. In some embodiments, the antenna assembly 100 disclosed herein can be a directional antenna assembly, and in some embodiments, the antenna assembly 100 disclosed herein can be mounted to a rail car for communication with a trackside or wayside antenna assembly while the rail car is in motion.

As seen, the antenna assembly 100 can include a first end of a feed and cable fairing 120 coupled to a directional element housing 130 at one end thereof, a radome 140 coupled to a second end of the directional element housing 130, a rear panel 170 coupled to a second end of the feed and cable fairing 120, and a baseplate 150 for mounting the assembly 100 to a second structure and for supporting each of the feed and cable fairing 120, the directional element housing 130, the radome 140, and the rear panel 170 on a first side of the baseplate 150.

The antenna assembly 100 can also include connectors or antenna feed ports 160 that extend through the baseplate and out of both first and second sides of the baseplate 150. The connectors 160 shown and described herein can include bulkhead connectors to allow custom cable types, connectors, and lengths to be supplied to the antenna assembly 100. However, in some embodiments, the connectors 160 can be eliminated, and a coaxial cable 160 as shown and described herein can be extended to a desired length and terminated with a desired connector.

It is to be understood that the baseplate 150 shown and described herein and the mounting features thereof can be adjusted from what is shown in the figures to enable the baseplate 150 to be mounted trackside and to be used as a stationary mounted antenna. It is to be further understood that the baseplate 150 and the mounting features thereof can be similarly modified to accommodate differing mounting surfaces, curvatures, attachment hole patterns, and mounting conditions.

Figure 4:
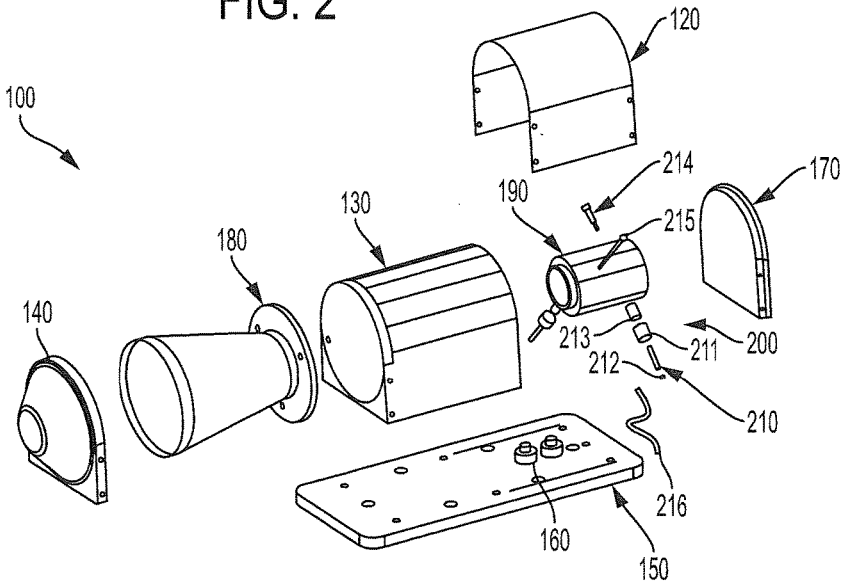
FIG. 4 is an exploded view of an antenna assembly in accordance with disclosed embodiments.
Figure 5:
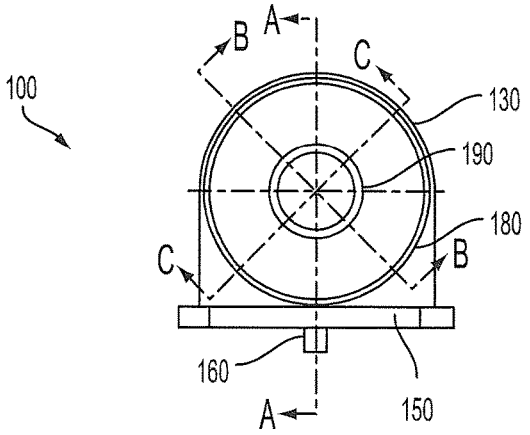
FIG. 5 is a cross-sectional view of an antenna assembly in accordance with disclosed embodiments.
Figure 6:
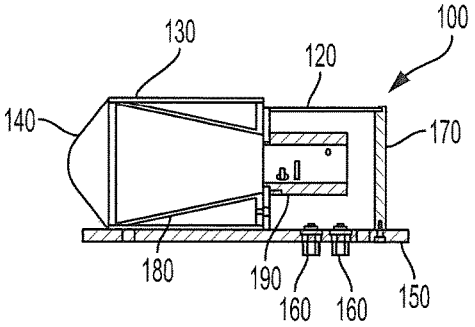
FIG. 6 is a cross-sectional view of an antenna assembly in accordance with disclosed embodiments along the A-A plane shown in FIG. 5.
Figure 7:
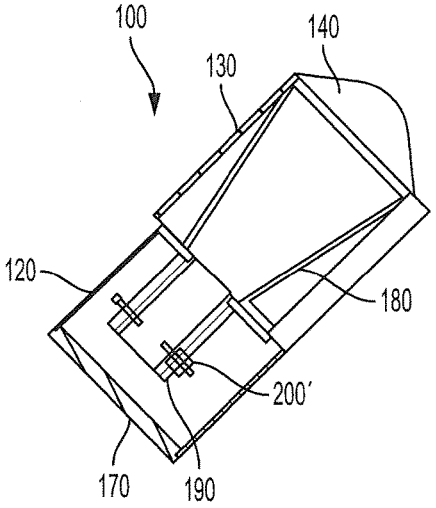
FIG. 7 is a cross-sectional view of an antenna assembly in accordance with disclosed embodiments along the B-B plane shown in FIG. 5.
Figure 8:
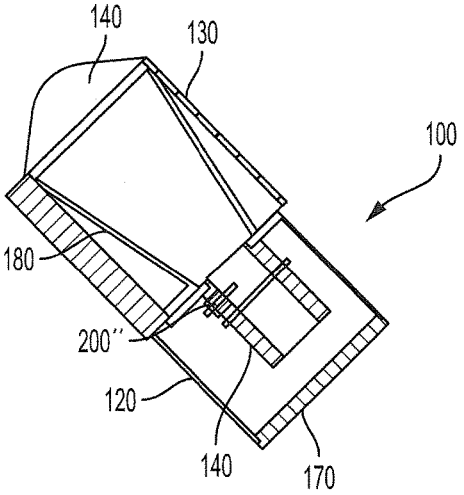
FIG. 8 is a cross-sectional view of an antenna assembly in accordance with disclosed embodiments along the C-C plane shown in FIG. 5.

FIG. 4 is an exploded view of the antenna assembly 100 in accordance with disclosed embodiments. Similarly, FIG. 5 is a cross-sectional view of the antenna assembly 100 in accordance with disclosed embodiments. FIG. 6 is a cross-sectional view of the antenna assembly 100 in accordance with disclosed embodiments along the A-A plane shown in FIG. 5, FIG. 7 is a cross-sectional view of the antenna assembly 100 in accordance with disclosed embodiments along the B-B plane shown in FIG. 5, and FIG. 8 is a cross-sectional view of the antenna assembly 100 in accordance with disclosed embodiments along the C-C plane shown in FIG. 5.

As seen, the directional element housing 130 can support and house a circular horn flair 180, and the feed and cable fairing 120 can support and house a waveguide feed 190, a probe feed assembly 200, a coaxial cable 216, a tuning pin 214, and a reflector septum 215. As further seen, the probe feed assembly 200 can include a driven probe 210, a connector body 211, an insulator 212, and a driven element insulator 213. It is to be understood that the shape, size, and properties of the horn flair 180, the waveguide feed 190, and the probe feed assembly 200 can be modified from what is shown in the figures to perform at various frequencies as would desired by one of ordinary skill in the art.

In operation, a signal can be supplied to at least one of the antenna feed ports 160 and propagate through the coaxial cable 216, which can terminate at the probe feed assembly 200. In some embodiments, the coaxial cable 216 can be a semi-rigid coaxial cable. A center conductor of the coaxial cable 216 can be terminated by the driven probe 210, and an outer conductor of the coaxial cable 216 can be terminated by the connector body 211. One or more of the insulators 212, 213 can position the coaxial cable 215 relative to the driven probe 210 and the connector body 211 and can prevent shorting. The probe feed assembly 200 can be terminated at the waveguide feed 190 and can radiate and excite a polarized signal wave within the waveguide feed 190. For example, the polarized signal can be linearly polarized and parallel to the driven probe 210.

Although only one probe feed assembly 200 is shown in FIG. 4, it is to be understood that the antenna assembly 200 in accordance with disclosed embodiments can include two or more probe feed assemblies. For example, each probe feed assembly can be fed separately via a respective antenna feed port 160 and coaxial cable 216. Illustratively, FIG. 7 shows a first probe feed assembly 200', and FIG. 8 shows a second probe feed assembly 200". When two probe feed assemblies are included in the antenna assembly 100, each probe feed assembly can be terminated orthogonally with respect to the other probe feed assembly so that two unique and orthogonal linearly polarized signal waves are introduced to the waveguide feed 190. For example, the first and second probe feed assemblies 200', 200" can be mounted orthogonally to one another and at +45° and −45° with respect to the mounting surface 5 and the waveguide feed 190. Alternatively, the first and second probe feed assemblies 200', 200" can be mounted orthogonally to one another and at 0° and 90° with respect to the mounting surface 5 and the waveguide feed 190.

Although the FIGS. 7 and 8 show two probe feed assemblies, it is to be understood that the antenna assembly 100 disclosed herein can include two or more probe feed assemblies. In embodiments with more than two probe feed assemblies, each of the probe feed assemblies can be mounted at any angle with respect to the mounting surface 5 and the waveguide feed 190 as would be desired by one of skill in the art.

Each unique signal wave introduced to the waveguide feed 190 can propagate independently down the waveguide feed 190 and be coupled to the circular horn flair 180. In some embodiments, the circular horn flair 180 can be highly optimized and couple each wave coupled thereto to free space in such a way that the signal patterns have a high degree of symmetry about an axis of the symmetrical horn shape. Furthermore, in some embodiments, the circular horn flair 180 can produce a signal pattern with significant gain. It is to be understood that the horn flair of the antenna assembly 100 disclosed herein can be replaced by any horn flair as would be desired by one of ordinary skill in the art with various horn flair profiles that can produce different signal patterns and achieve increased or decreased gain.

The radome 140 shown and described herein can include a dielectric material that can pass radiated RF signals while simultaneously environmentally protecting the horn flair 180, the waveguide feed 190, and the probe feed assembly 200.

In some embodiments, some or all of the exterior and semi-exterior components of the antenna assembly 100, including the feed and cable fairing 120, the directional element housing 130, the waveguide feed 190, the horn flair 180, the rear panel 170, and the baseplate 150 can be metallic or include a metallic material. Some or all of these components can be grounded together, and in some embodiments, can be DC grounded to a mounting surface. In the event of a high voltage or high current discharge to the antenna assembly 100, such a discharge can also be grounded to the mounting surface. The driven probe 210 need not be DC grounded. However, because the driven probe 210 is embedded deeply with the antenna assembly 100 and surrounded by grounded structure, the driven probe 210 will not experience the high voltage or high current discharge.

Figure 9:
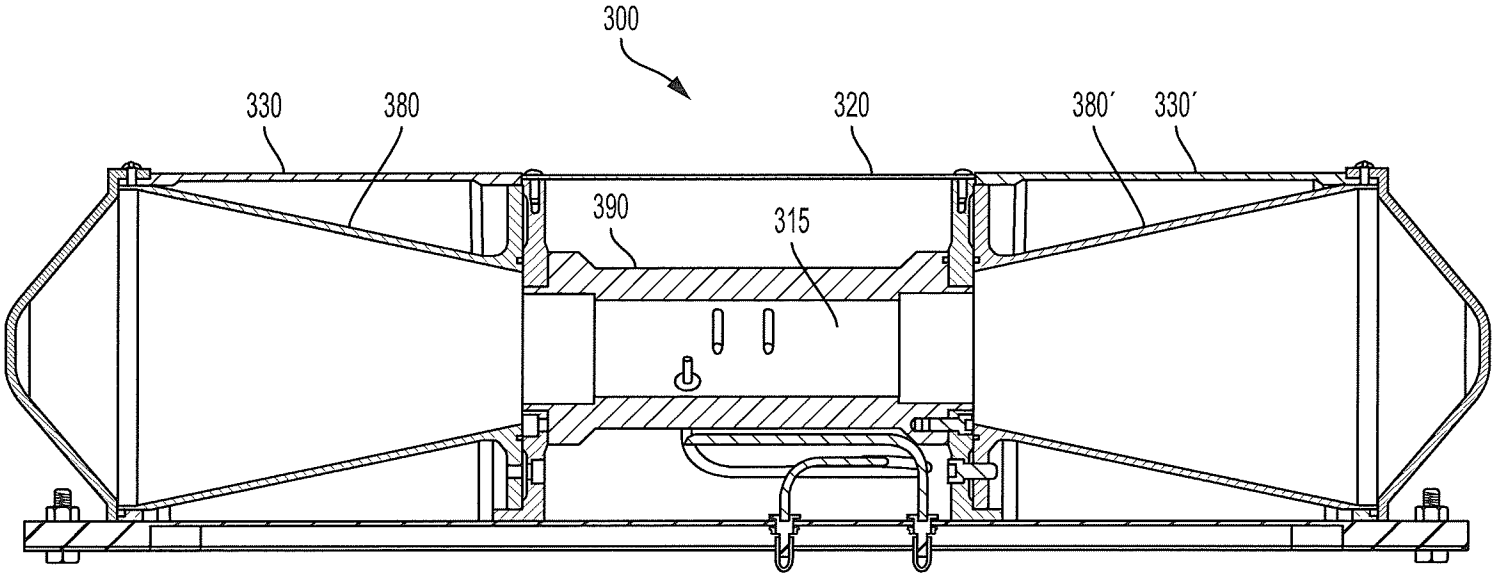
FIG. 9 is a cross-sectional view of an antenna assembly with two horn flairs in accordance with disclosed embodiments.

FIG. 9 is a cross-sectional view of an antenna assembly 300 with two horn flairs 380, 380' in accordance with disclosed embodiments. As discussed above and as seen in FIG. 9, the feed and cable fairing 320 can support and house a reflector septum 315. In some embodiments, the septum 315 can be removed to open both ends of the waveguide feed 390, thereby making the waveguide feed 390 bidirectional. In these embodiments, a second horn flair 380' housed within a second directional element housing 330' can be included in the assembly 300 and terminate a second end of the waveguide feed 390 opposite the first horn flair 380 to make the antenna assembly 300 bidirectional.

From the foregoing, it will be observed that numerous variations and modifications may be effected without departing from the spirit and scope of the invention. It is to be understood that no limitation with respect to the specific system or method illustrated herein is intended or should be inferred. It is, of course, intended to cover by the appended claims all such modifications as fall within the spirit and scope of the claims.

What is claimed is:

1. An antenna assembly comprising:

a waveguide feed that includes a septum;

first and second probe feed assemblies terminating at the waveguide feed; and a horn flair coupled to a first end of the waveguide feed, wherein the first probe feed assembly is orthogonal with respect to the second probe feed assembly, wherein each of the first and second probe feed assemblies is fed separately and radiates a respective linearly polarized signal into the waveguide feed that is parallel to a respective one of the first and second probe feed assemblies, wherein the respective linearly polarized signal radiated from each of the first and second probe feed assemblies propagates independently through the waveguide feed to the horn flair, which couples the respective linearly polarized signal radiated from each of the first and second probe feed assemblies to free space, wherein the septum creates directionality in the waveguide feed, and wherein removal of the septum makes the waveguide feed bidirectional.

2. The antenna assembly of claim 1 wherein the first probe feed assembly is mounted at +45° with respect to a mounting surface, and wherein the second probe feed assembly is mounted at −45° with respect to the mounting surface.

3. The antenna assembly of claim 1 wherein the first probe feed assembly is mounted at 0° with respect to a mounting surface, and wherein the second probe feed assembly is mounted at 90° with respect to the mounting surface.

* * * * *